US008038032B2

(12) United States Patent
Faller et al.

(10) Patent No.: US 8,038,032 B2
(45) Date of Patent: Oct. 18, 2011

(54) TOPPING DISPENSER

(75) Inventors: James Faller, Williamsville, NY (US); Christopher V. Tirone, East Aurora, NY (US); Gerald A. Rusch, Fond Du Lac, WI (US)

(73) Assignee: Rich Products Corporation, Buffalo, NY (US)

( * ) Notice: Subject to any disclaimer, the term of this patent is extended or adjusted under 35 U.S.C. 154(b) by 544 days.

(21) Appl. No.: 12/141,612

(22) Filed: Jun. 18, 2008

(65) Prior Publication Data

US 2008/0314923 A1 Dec. 25, 2008

Related U.S. Application Data

(60) Provisional application No. 60/945,787, filed on Jun. 22, 2007.

(51) Int. Cl.
*B65D 35/28* (2006.01)

(52) U.S. Cl. ..... 222/101

(58) Field of Classification Search ..... 222/93–98, 222/101–102, 105, 183, 185.1, 252, 256, 222/386.5, 391, 386
See application file for complete search history.

(56) References Cited

U.S. PATENT DOCUMENTS

| | | | | |
|---|---|---|---|---|
| 3,232,488 | A * | 2/1966 | Headberg | 222/101 |
| 4,331,265 | A * | 5/1982 | Warlick | 222/101 |
| 4,403,714 | A * | 9/1983 | Kane | 222/101 |
| 4,513,885 | A * | 4/1985 | Hogan | 222/95 |
| 6,454,133 | B1 * | 9/2002 | Lopez et al. | 222/102 |
| 6,659,309 | B2 * | 12/2003 | Friedman | 222/97 |
| 6,691,894 | B2 | 2/2004 | Chrisman et al. | |
| 6,789,703 | B2 * | 9/2004 | Pierre-Louis | 222/101 |
| 7,669,735 | B1 * | 3/2010 | Alleyne | 222/102 |
| 2007/0023456 | A1 | 2/2007 | Jalali et al. | |

* cited by examiner

*Primary Examiner* — Kevin P Shaver
*Assistant Examiner* — Andrew Bainbridge
(74) *Attorney, Agent, or Firm* — Hodgson Russ LLP

(57) ABSTRACT

A topping dispenser for dispensing serving portions of topping onto beverages and desserts comprises a housing having a front product compartment and a rear drive compartment separated by a partition. The product compartment is adapted to receive a pastry bag containing topping such that the bag is suspended against the partition, and a vertically displaceable roller is provided in the product compartment to roll down along the partition to squeeze contents of the bag out through a bottom dispensing tip of the bag that extends through an opening in the housing to direct product onto a waiting beverage. The roller is advanced downward in predetermined increments by a pawl drive mechanism located in the drive compartment and coupled to the roller by a mounting bracket extending through travel slots in the partition. The pawl drive mechanism is actuated by an operating lever pivotally mounted on the housing.

13 Claims, 10 Drawing Sheets

TOPPING DISPENSER

CROSS-REFERENCE TO RELATED APPLICATIONS

This application claims priority benefit of U.S. Provisional Patent Application 60/945,787 filed Jun. 22, 2007, which is incorporated herein by reference.

FIELD OF THE INVENTION

The present invention relates generally to dispensing machines for food products, and more particularly to a dispensing machine for dispensing serving portions of toppings, condiments, and the like from a plastic bag container. The invention is useful for applying whipped topping to hot or cold coffee, desserts, shakes, iced cappuccinos, and frozen drinks.

BACKGROUND OF THE INVENTION

A topping dispenser is needed having the following characteristics:

- it accepts commercially available prepackaged bags of topping or other product;
- it is adapted for easy and clean loading of full product bags and unloading of emptied product bags;
- it is easily operated and may be self-serve for consumers;
- it dispenses consistently-sized serving portions;
- it fully evacuates the product bag to minimize product waste;
- it is compact so as to occupy very little counter space; and
- it is mechanically simple and dependable.

SUMMARY OF THE INVENTION

A topping dispenser formed in accordance with an embodiment of the present invention comprises a housing defining a front product compartment and a rear drive compartment separated by a partition, wherein the product compartment is elevated relative to a base of the housing for receiving a cup, glass or mug beneath the product compartment. The partition includes a thin channel portion having a bag slot for receiving an upper end portion of a pastry bag containing product to be dispensed, and a clamping plate slideably received by the channel portion pinches the upper end portion of the bag to hold the bag in place such that the bag hangs downward against the partition. The product compartment has an opening through a bottom wall thereof through which a dispensing tip of the bag may be inserted to direct product into a cup, glass, mug, or plate placed beneath the dispensing tip. A roller is confined in the product compartment for vertically directed rolling motion. The roller is connected to a pawl drive mechanism residing in the drive compartment and connected to the roller by a U-shaped mounting bracket having legs extending through a pair of travel slots in the partition. A spring-loaded operating lever is pivotally mounted at the top or a lower sidewall of the housing and may be manually pivoted through a drive stroke to actuate a drive rod of the pawl drive mechanism to advance the roller in a downward direction. A pawl release member is accessible through the product compartment to enable the roller to be reset at its upper starting location.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
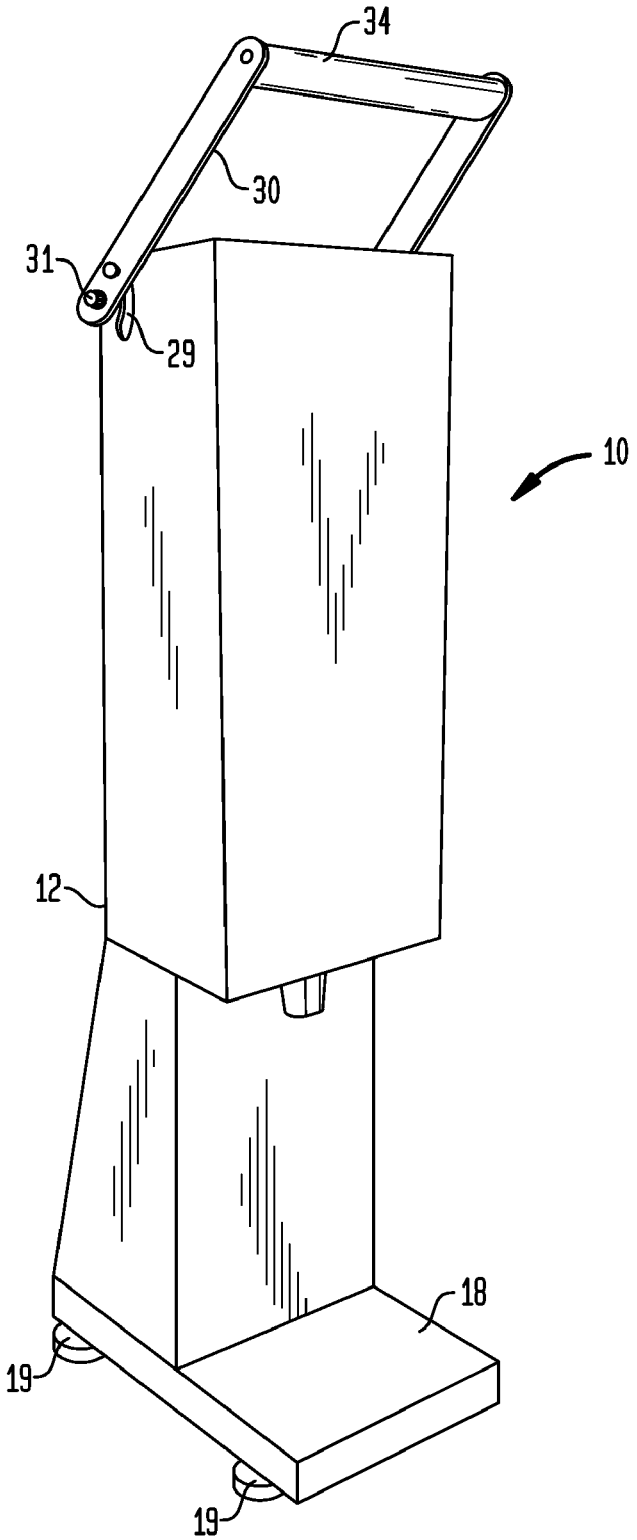
FIG. 1 is a perspective view of a topping dispenser formed in accordance with an embodiment of the present invention.
Figure 2:
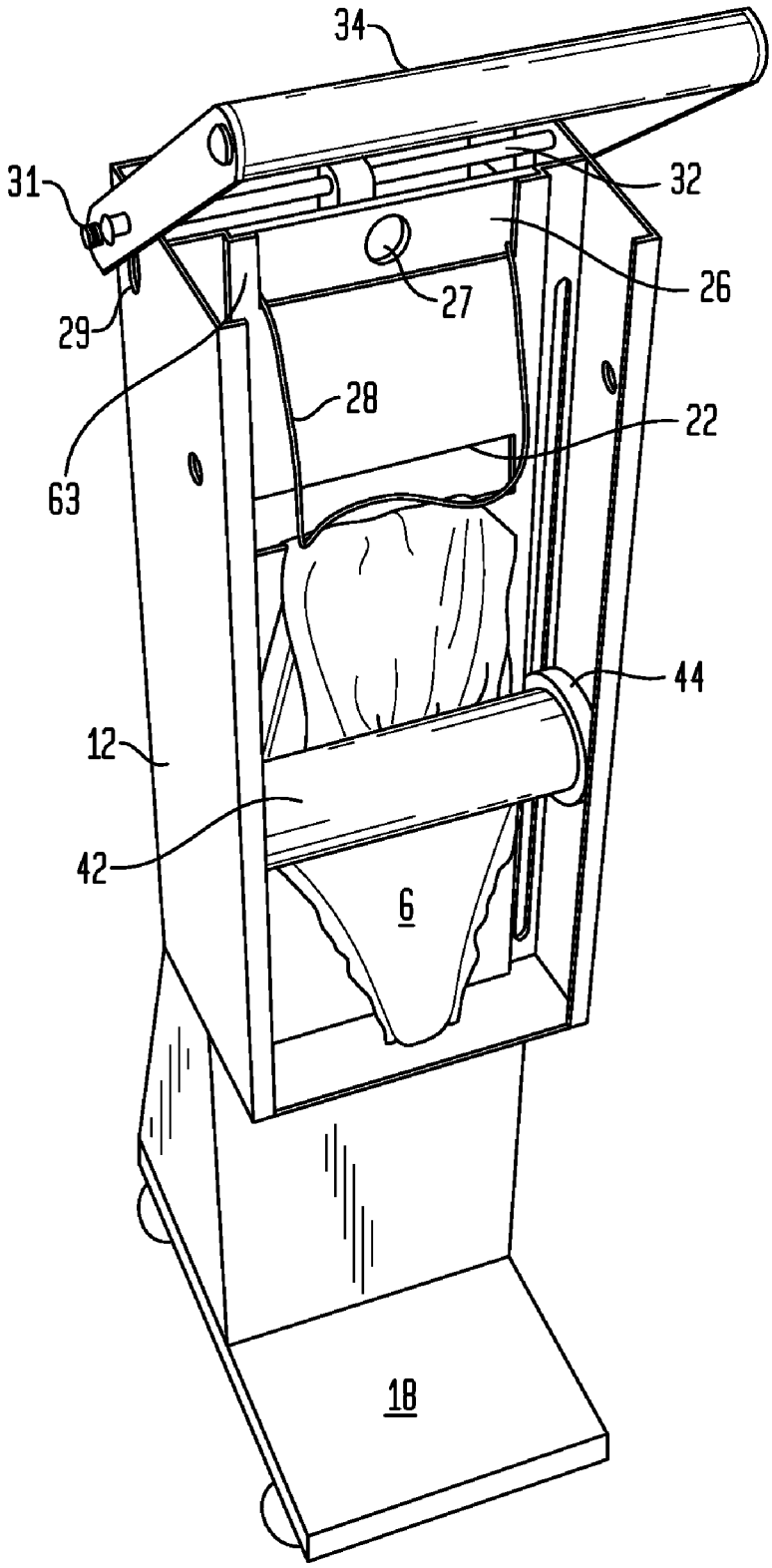
FIG. 2 is a perspective view of the topping dispenser shown in FIG. 1, with a front panel removed to reveal a product compartment of the dispenser.
Figure 3:
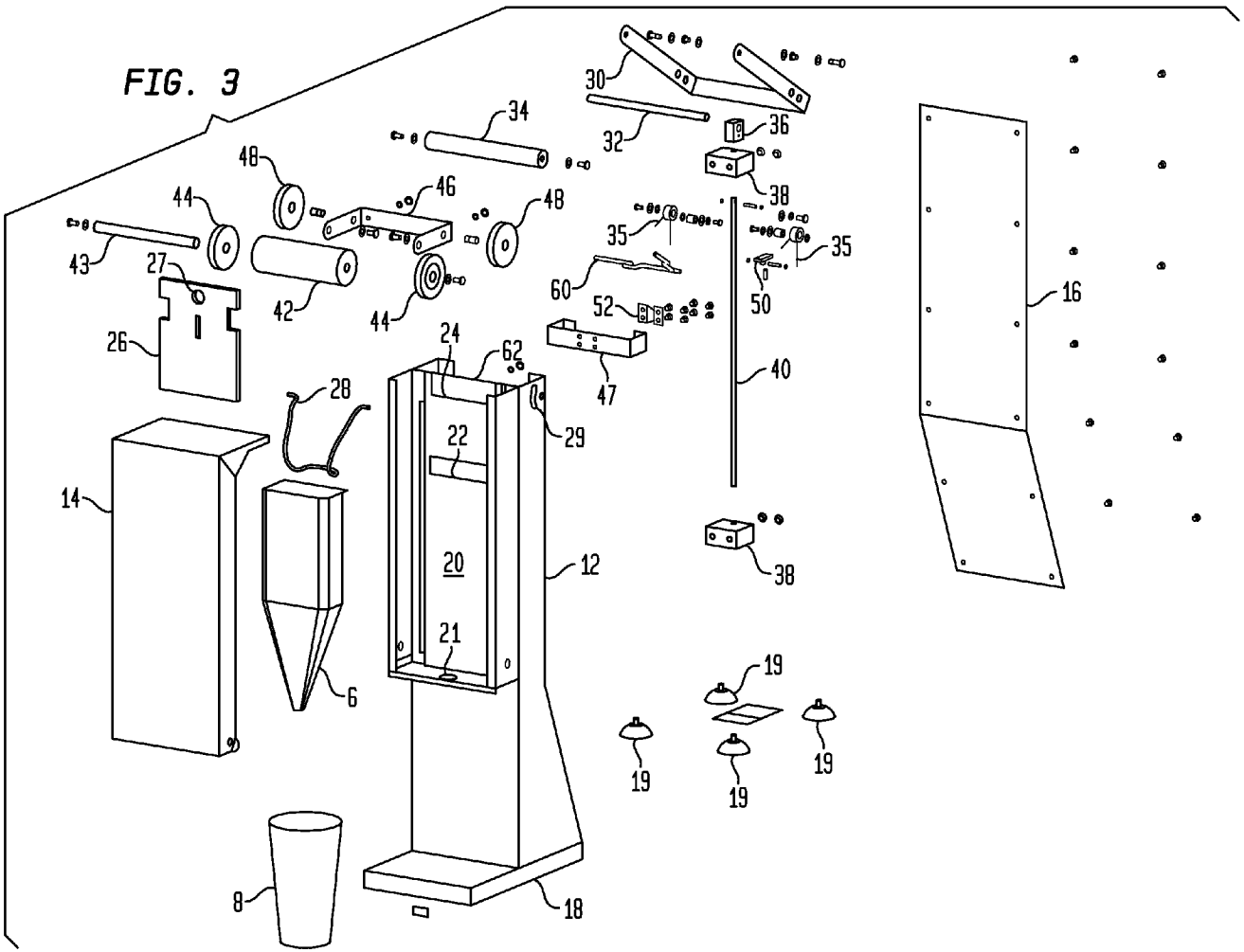
FIG. 3 is an exploded perspective view of the topping dispenser shown in FIG. 1.
Figure 4:
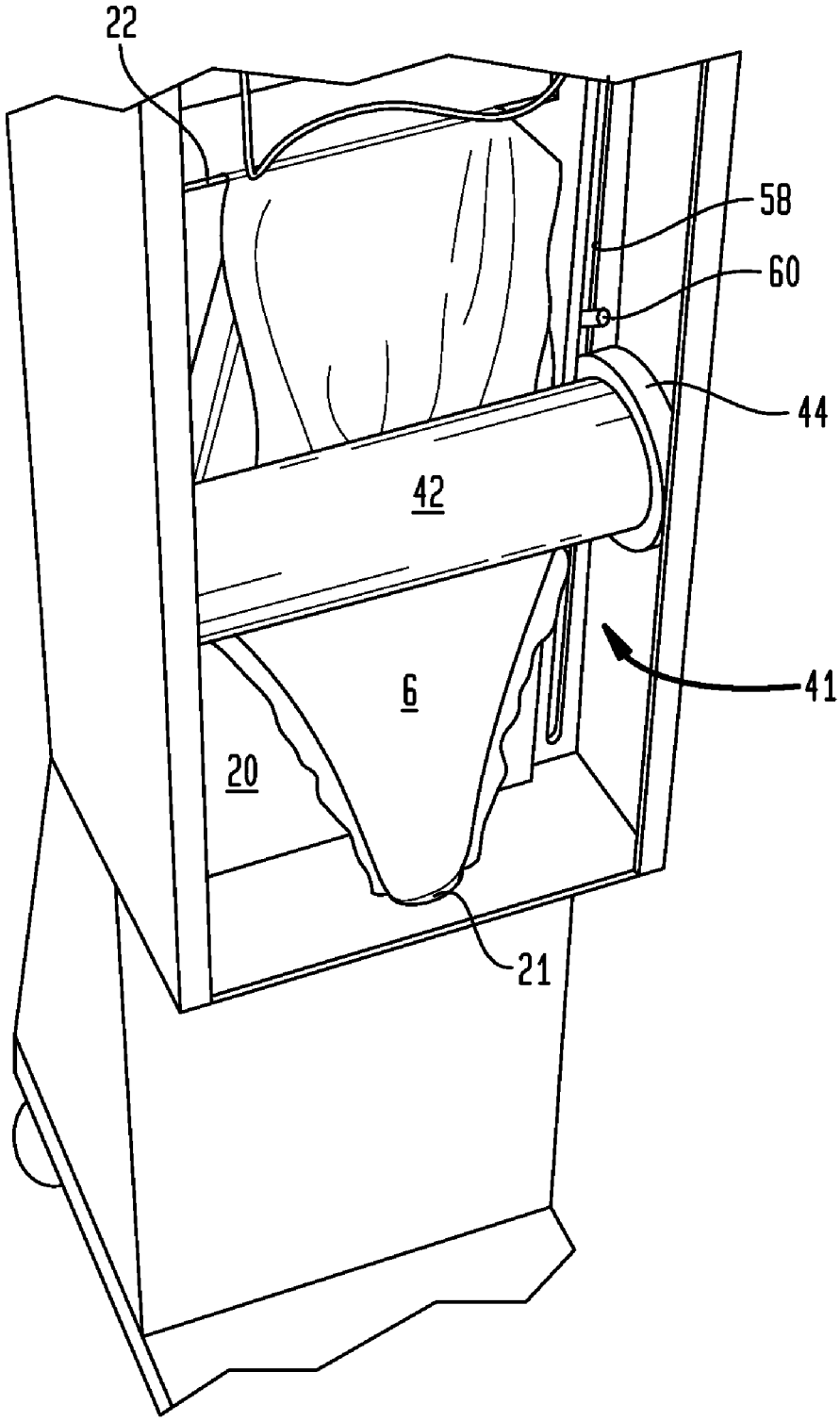
FIG. 4 is an enlarged perspective view of the product compartment of the topping dispenser shown in FIG. 1.
Figure 5:
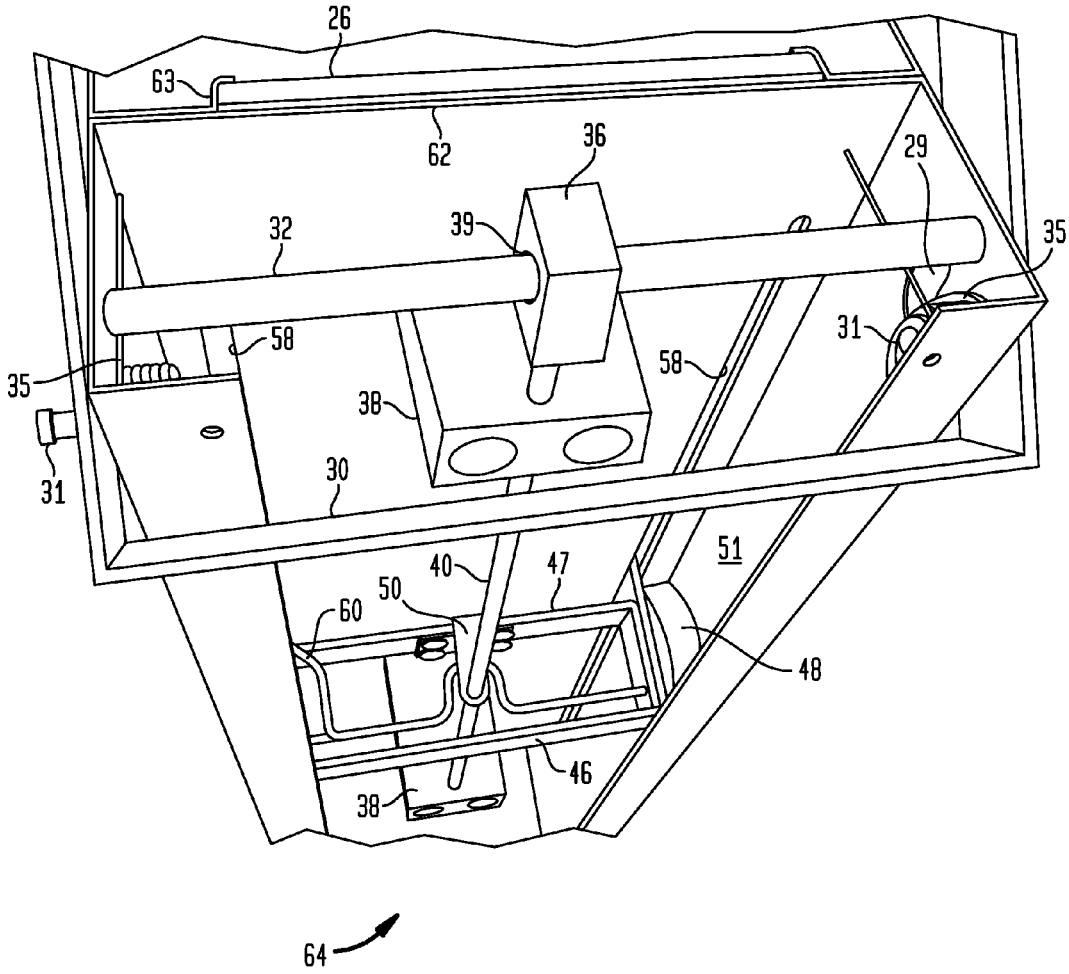
FIG. 5 is a perspective view of a drive compartment of the topping dispenser shown in FIG. 1.
Figure 6:
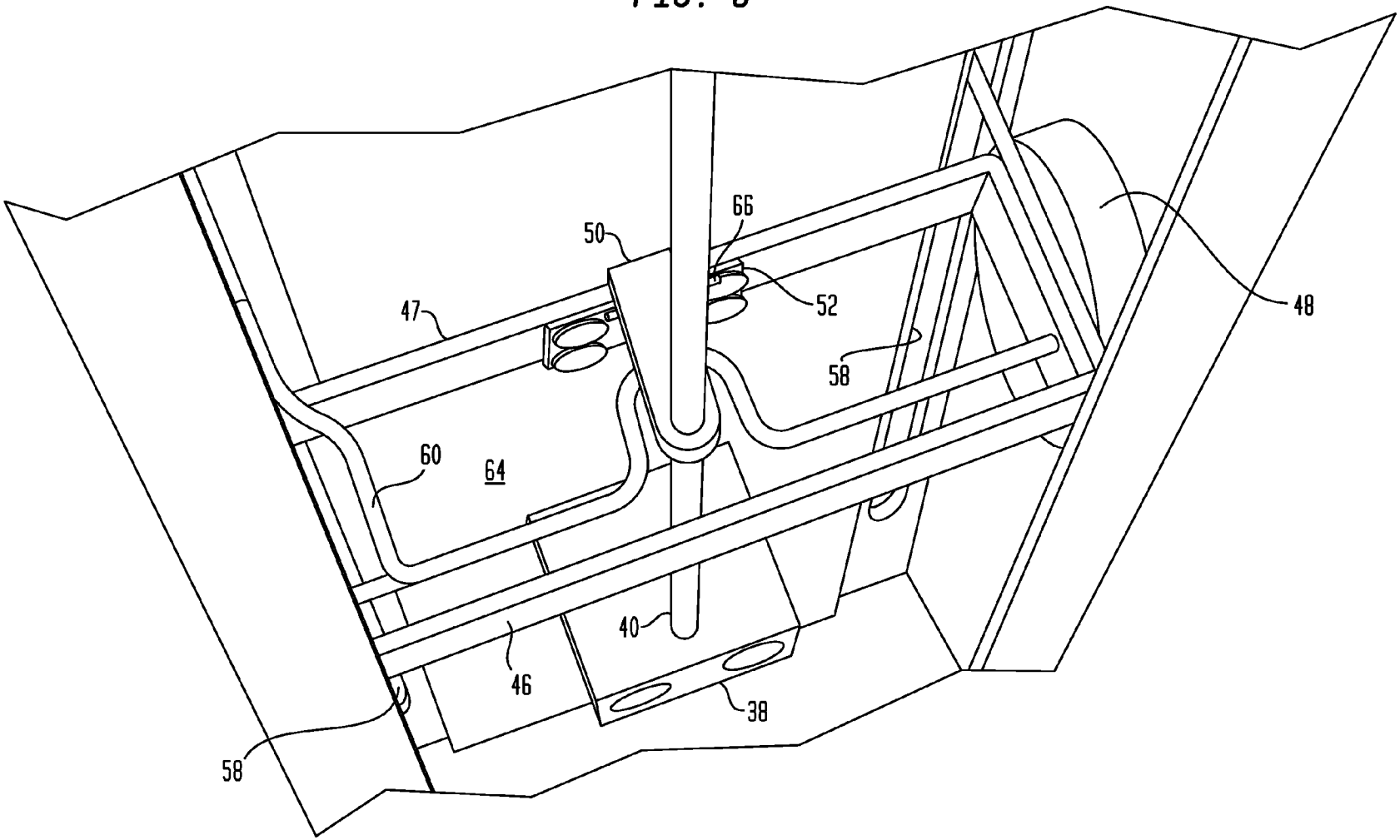
FIG. 6 is a further perspective view of the drive compartment.
Figure 7:
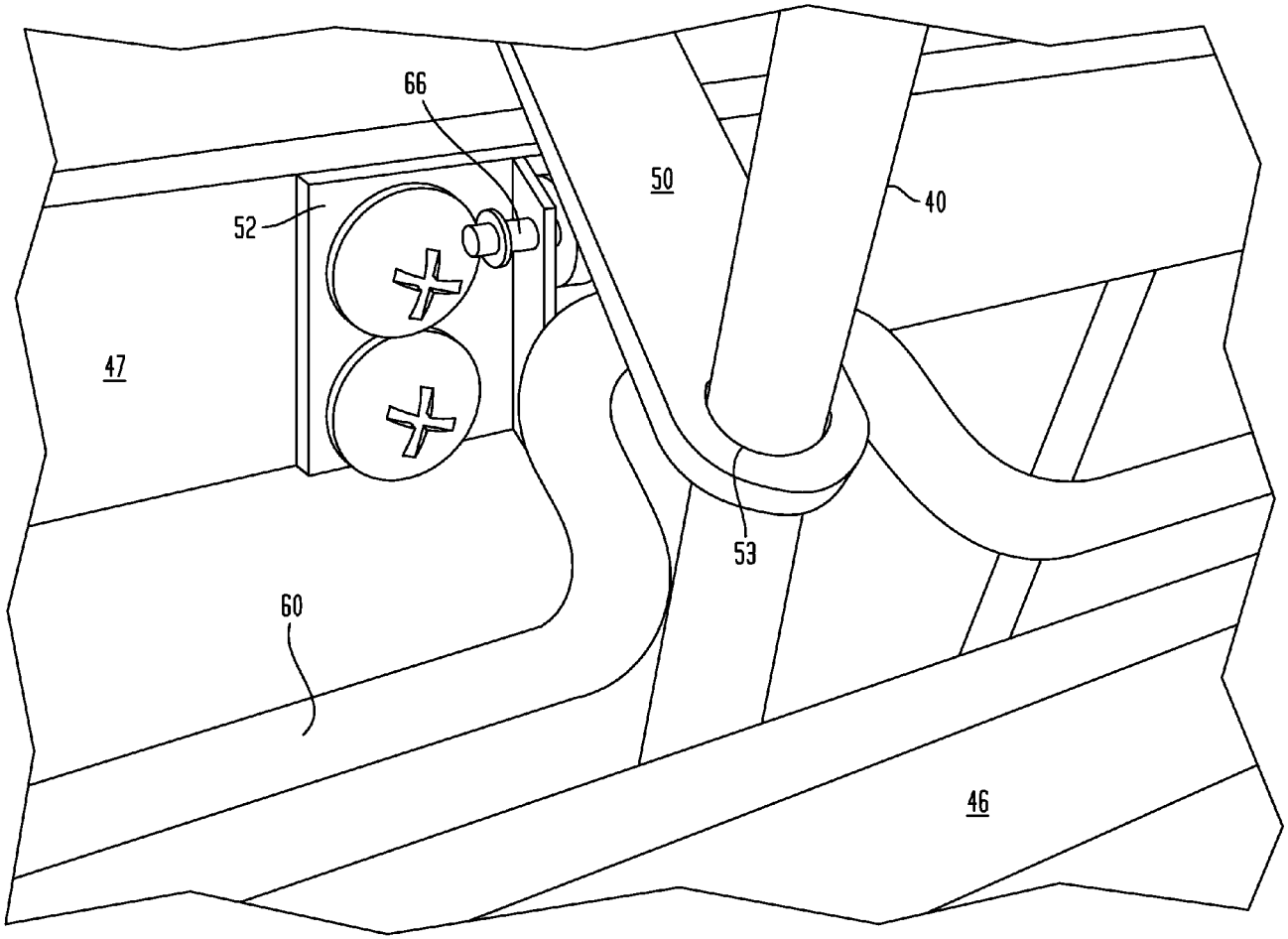
FIG. 7 is an enlarged perspective view of a pawl assembly of the topping dispenser shown in FIG. 1.

A topping dispenser formed in accordance with an embodiment of the present invention is shown in FIG. 1 and identified generally by reference numeral 10. Topping dispenser 10 comprises an upstanding housing 12 supported on a base 18, and an operating lever 30 pivotally mounted on an upper portion of housing 12 by a pair of pivot pin assemblies 31. Operating lever 30 includes a handle 34 to be gripped by a user. Housing 12 may be formed of a material that withstands moisture and is easily cleaned, such as stainless steel, plastic, ceramic, or the like.

Reference is also made now to FIGS. 2-7. Housing 12 includes a removable front panel 14 covering a front product compartment 20, a removable rear panel 16 covering a rear drive compartment 64, and a partition 62 between product compartment 20 and drive compartment 64. Front panel 14 and rear panel 16 may be snap fitted on housing 12, mounted by hinges in the manner of a door, or otherwise mounted for easy removal and replacement, it being recognized that front panel 14 will require removal in the regular course of using dispenser 10, whereas rear panel 16 will require removal only for purposes of servicing or repairing a drive mechanism of the dispenser. As may be seen, product compartment 20 is spaced vertically from base 18 and protrudes over base 18, whereby a cup-receiving space is provided beneath product compartment 20 for receiving a cup 8 into which topping or other product may be dispensed. Base 18 may be provided with suction cups 19 or feet to prevent it from sliding on a countertop or other support surface.

Partition 62 includes a channel portion 63 at the rear of product compartment 20. Channel portion 63 includes a bag slot 22 for receiving an upper end portion of a pastry bag 6 (or another type of plastic bag) containing topping or other product to be dispensed, and a top recess 24 facilitating insertion and removal of a bag clamping plate 26 into and out of a channel defined by channel portion 63. Clamping plate 26 may include a hole 27 (or multiple holes or slots) making it easier to slide the plate into and out of the channel, and may be advantageously formed from a rigid, low friction material such as PTFE or the like. As may be understood, clamping plate 26 acts to pinch the upper end portion of pastry bag 6 against channel portion 63 to suspend the pastry bag within product compartment 20. An opening 21 is provided through a bottom wall of product compartment 20 through which a dispensing tip of pastry bag 6 is inserted, and may be captured by snap-fit or other securing means.

In order to force contents from pastry bag 6, a cylindrical roller 42 is disposed horizontally within product compartment 20. Roller 42 is mounted on an axle 43 between a pair of coaxially mounted guide wheels 44 provided one at each opposite end of the roller. A U-shaped mounting bracket 46 is arranged with its legs extending from drive compartment 64 through a pair of travel slots 58 into product compartment 20 for supporting axle 43 and connecting axle 43, roller 42, and guide wheels 44 to a drive mechanism described below. The legs of mounting bracket 46 include aligned holes for receiving axle 43, and the bracket legs are arranged between each end of roller 42 and the respective guide wheel 44. A pivotable wire bail 28 is hung from top recess 24 of channel portion 63 for holding roller 42 in an upward location above bag slot 22 during removal of an emptied product bag and insertion of a full bag. As may be seen, housing 12 defines a pair of guide tracks 41 on opposite sides of product compartment 20 for receiving guide wheels 44, whereby roller 42 is confined to travel up and down within product compartment 20 by rotation about axle 43.

In accordance with the present invention, roller 42 is advanced downward in controlled fashion by a drive mechanism provided in drive compartment 64 that is responsive to actuation of operating lever 30. The drive mechanism of the present embodiment is best seen in FIGS. 3 and 5-7, and includes a push bar 32 traversing operating lever 30 and spaced from the pivot axis of operating lever 30 defined by pivot pin assemblies 31. Push bar 32 is received through a pair of arcuate slots 29 provided through opposite sidewalls of housing 12. Operating lever 30 is biased by a pair of torsion springs 35 associated with pivot pin assemblies 31 toward a "handle up" pivot position as shown in FIG. 1. As may be understood, pivotal motion of operating lever 30 is limited by the ends of arcuate slots 29.

A coupler block 36 is mounted at an intermediate location along push bar 32, which passes through a slightly elongated slot 39 in the coupler block. As a result, coupler block 36 travels in a vertical direction as operating lever 30 and push bar 32 are pivoted about the pivot axis defined by pivot pin assemblies 31. A drive rod 40 is fixed to depend downwardly from coupler block 36 and passes slidably through aligned holes in upper and lower bearing blocks 38 fixed to partition 62. Accordingly, as operating lever 30 is pivoted downward from the position shown in FIG. 1, drive rod 40 is vertically displaced in a downward direction through a distance that is proportional to the angular (pivotal) displacement of operating lever 30.

Mounting bracket 46 carrying roller 42 is connected to drive rod 40 by a pawl assembly that in the present embodiment includes a channel bracket 47 fixed to an interior portion of mounting bracket 46, a pawl support bracket 52 fixed to channel bracket 47, and a pawl 50 pivotally mounted to pawl support bracket 52 by a pivot pin 66 and having a hole 53 spaced from pivot pin 66 through which drive rod 40 passes with slight clearance. Pawl 50 is maintained at an angle relative to drive rod 40 that differs slightly from ninety degrees by a coil spring (not visible) acting between pawl support bracket 52 and pawl 50 such that as drive rod 40 is displaced in a downward direction, it carries pawl 50 and brackets 52, 47, and 46 with it to move roller 42 downward. As may be understood, pawl 50 acts in one-way ratcheting manner so that roller 42 is not carried back up when operating lever 30 is pivoted back to the position shown in FIG. 1. A pair of guide wheels 48 may be arranged on opposite sides of mounting bracket 46 to run within guide tracks 51 at opposite sides of drive compartment 64 to provide smooth and stable vertical motion. As roller 42 advances downward, it acts in conjunction with an opposing surface of partition 62 to squeeze product downward in bag 6 to force product from the dispensing tip located at the bottom of the bag.

A pawl release member 60 is provided for temporarily releasing pawl 50 so that roller 42 may be moved manually in an upward direction to reset the roller at an upper location within product compartment 20. Pawl release member 60 includes a transverse portion rotatably journaled at its opposite ends by channel bracket 47 and having a U-bend extending underneath pawl 50 between drive rod 40 and pivot pin 66, and a lever portion extending from the transverse portion through a travel slot 58 into product compartment 20. A terminal end of the lever portion of pawl release member 60 may be urged back toward partition 62 to engage the U-bend against the underside of pawl 50 to adjust the angle of pawl 50 relative to drive rod 40 so that the roller and pawl mechanism may be moved in an upward direction along drive rod 40.

Use of dispenser 10 will now be described. Initially, front panel 14 is removed and roller 42 is held at an upper location in product compartment 20 by wire bail 28. A pastry bag 6 containing topping or the product to be dispensed is installed by inserting a lower dispensing tip of the pastry bag through opening 21, sliding clamping plate 26 up, placing an upper end portion of bag 6 into bag slot 22, and sliding clamping plate 26 back down to hold the upper end portion of the bag in place such that the bag rests against channel portion 63 of partition 62. Bail 28 may then be pivoted up slightly so that it no longer prevents downward advance of roller 42. Front panel 14 is then replaced on housing 12, and a cup 8 is positioned underneath opening 21. To dispense product from bag 6 into cup 8, handle 34 is grasped and operating lever 30 is manually pivoted down through its stroke to actuate the drive mechanism and move roller 42 over pastry bag 6, thereby applying pressure to squeeze contents from the pastry bag through the dispensing tip and into cup 8. When handle 34 is released, torsion springs 35 cause operating lever 30 to return to its original position.

When the contents of bag 6 have been exhausted, roller 42 may be reset and the bag replaced as follows. Front panel 14 is removed or opened, pawl release member 60 is used to release pawl 50, and roller 42 is manually repositioned upward into bail 28. The dispensing tip of bag 6 is pulled up out of opening 21 and clamping plate 26 is slid upward to release the spent bag, which is then removed from product compartment 20. A new, full bag may then be installed as described above.

Figure 8:
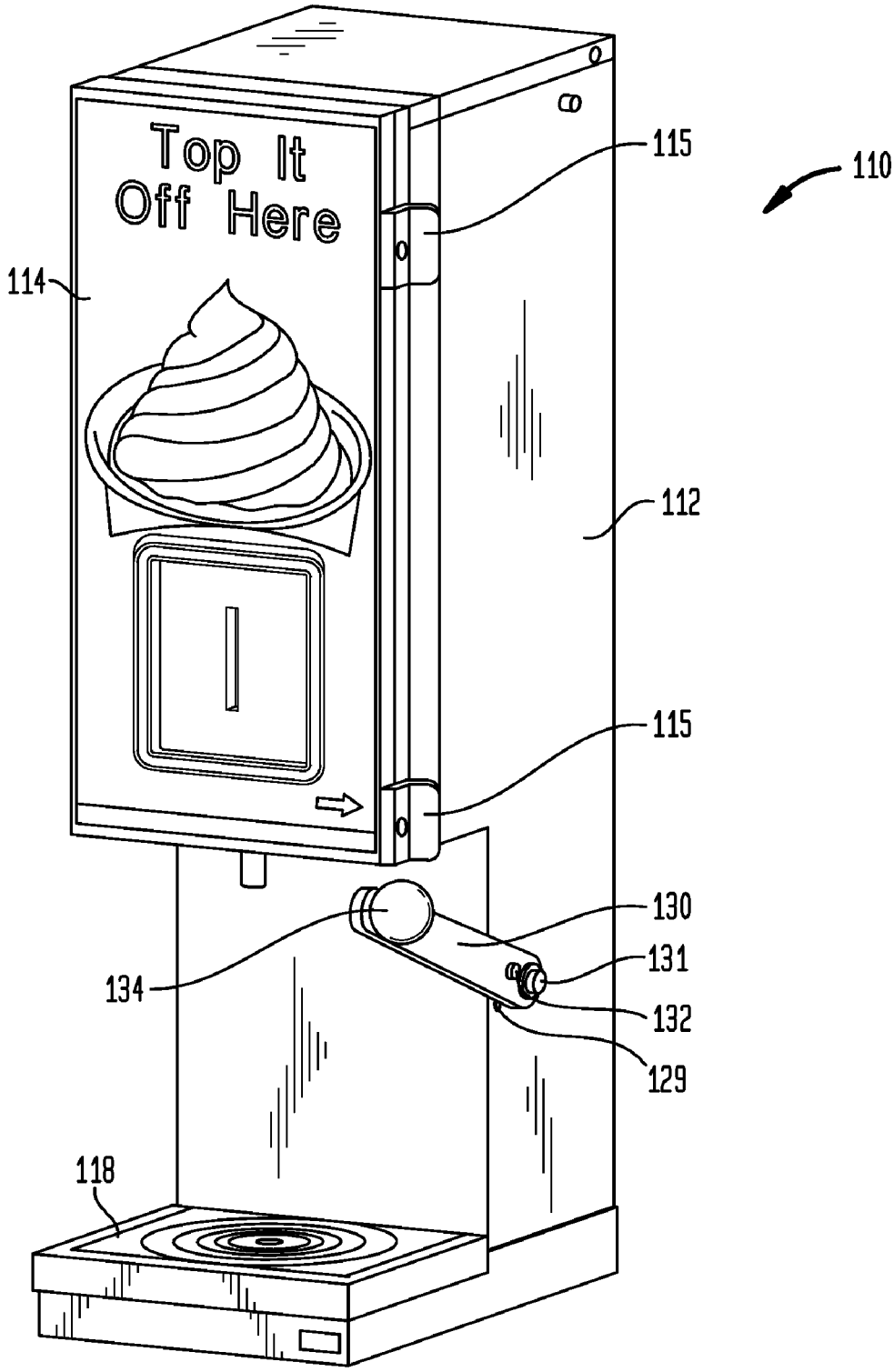
FIG. 8 is a perspective view of a topping dispenser formed in accordance with another embodiment of the present invention.
Figure 9:
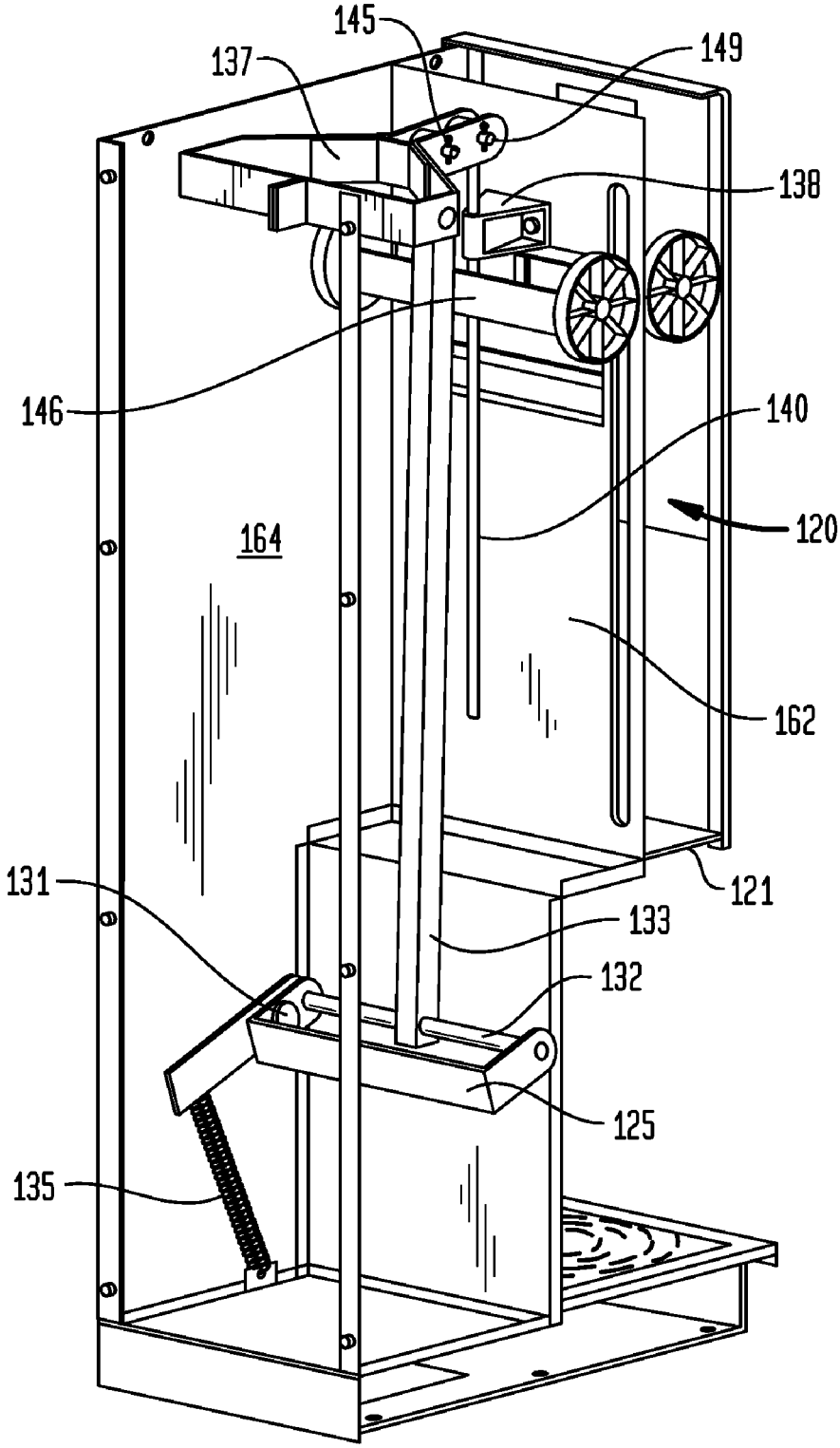
FIG. 9 is a perspective view of a drive compartment of the topping dispenser shown in FIG. 8.
Figure 10:
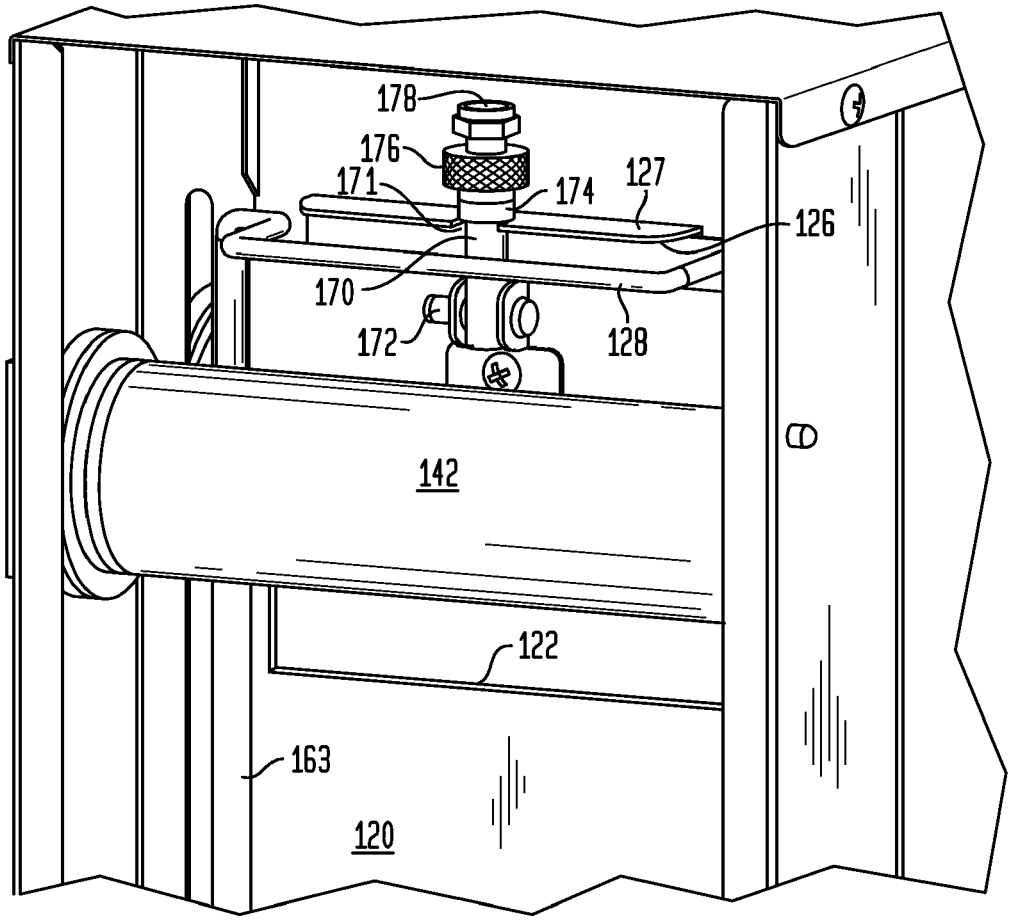
FIG. 10 is an enlarged perspective view of the product compartment of the topping dispenser shown in FIG. 8.

For certain applications, it is desirable to have the operating lever at a lower position relative to the housing for ease of reach and improved stability. Accordingly, reference is now made to FIGS. 8-10 illustrating a topping dispenser 110 formed in accordance with an alternative embodiment of the present invention. The embodiment of FIGS. 8-10 is generally similar in construction and operation to that of FIGS. 1-7, however topping dispenser 110 has an operating lever 130 pivotally mounted to a housing 112 of the dispenser at a vertical location above a base 118 of the dispenser but below a bottom wall 121 of product compartment 120, and a modified bag capture arrangement. In addition, housing 112 has a front panel 114 that is mounted on the housing by hinges (not shown) and releasably secured in a closed position by a pair of latches 115 for easy door-like opening.

As may be understood from FIGS. 8 and 9, operating lever 130 is pivotally mounted on a sidewall of housing 112 by a pivot pin assembly 131 and may have a handle or knob 134 at its front end. The drive mechanism of dispenser 110 includes a U-shaped bracket 125 arranged within a drive compartment 164 of housing 112 and coaxially mounted with operating lever 130 by pivot pin assembly 131 for pivotal motion with the operating lever 130 about a pivot axis defined by the pivot pin assembly 131, and a push bar 132 traversing U-shaped bracket 125 and spaced from the pivot axis of operating lever 130 defined by pivot pin assembly 131. Push bar 132 is received through an arcuate slot 129 provided through the associated sidewall of housing 112. Operating lever 130 is biased by a spring 135 associated with pivot pin assembly 131 toward a "handle up" pivot position as shown in FIG. 8. As may be understood, pivotal motion of operating lever 130 is limited by the ends of arcuate slot 129.

Push bar 132 is connected to a vertically extending drive rod 140 by a linkage having a generally vertical first member 133 pivotally coupled to the push bar and extending upward from the push bar, and a generally horizontal second member 137 pivotally coupled to an upper end of the first member 133 by a pivot pin 145 and pivotally coupled to an upper end of drive rod 140 by a pivot pin 149. Drive rod 140 depends downwardly from second member 137 and is received and guided for vertically directed sliding motion by a bearing 138 fixed to a partition 162 of housing 112. Consequently, as operating lever 130 is pivoted downward from the position shown in FIG. 8, drive rod 140 is vertically displaced in a downward direction through a distance that is proportional to the angular (pivotal) displacement of operating lever 130.

The remainder of the drive mechanism of dispenser 110 is substantially similar to that shown and described with respect to dispenser 10 of the first embodiment.

Dispenser 110 has a modified arrangement for securing a bag 6 within product compartment 120 as compared to the arrangement of dispenser 10. As may be seen in FIG. 10, partition 162 includes a channel portion 163 at the rear of product compartment 120. Channel portion 163 includes a bag slot 122 for receiving an upper end portion of a pastry bag 6 (or another type of plastic bag) containing topping or other product to be dispensed. A bag clamping plate 126 is insertable into and removable out of a channel defined by channel portion 163, and may include a flange 127 along an upper edge of the bag clamping plate. Clamping plate 126 acts to pinch the upper end portion of pastry bag 6 against channel portion 163 and/or against a horizontal land surface (not shown) within channel portion 163 to suspend the pastry bag within product compartment 120. A locking arm 170 is pivotally mounted to the front of channel portion 163 by a pivot pin assembly 172 and may be received within a slot 171 provided in flange 127. A bushing 174 is provided on locking arm 170 and may be tightened against a top surface of flange 127 by a knurled nut 176 threadably adjustable along locking arm 170, whereby the bag clamping plate may be secured in place while it is holding a product bag. When it is time to replace the product bag, the nut 176 may be loosened relative to flange 127 and the locking arm 170 pivoted forward to allow clamping plate 126 to be moved upward sufficiently to release the spent bag; when the clamping plate is moved up, the locking arm may be pivoted back to an upright orientation and the flange 127 may be rested on a top enlarged head 178 of the locking arm while a new product bag is installed. A wire handle member 128 may be coupled to roller 142, whereby a user may pull the handle member and roller upward and engage the handle member against a catch surface (not shown) to reset the roller.

While the invention has been described in connection with exemplary embodiments, the detailed description is not intended to limit the scope of the invention to the particular forms set forth. The invention is intended to cover such alternatives, modifications, and equivalents of the described embodiment as may be included within the spirit and scope of the invention.

What is claimed is:

1. A topping dispenser comprising:

a base;

a housing supported by the base, the housing including a product compartment for receiving a pastry bag and drive compartment adjacent the product compartment, wherein the product compartment includes a bottom wall spaced from the base, the bottom wall having an opening therethrough;

a clamping member operable to clamp an upper portion of the pastry bag to suspend the pastry bag within the product compartment such that a lower dispensing tip of the pastry bag is insertable through the opening in the bottom wall of the product compartment;

a roller disposed within the product compartment for rotation about an axis, the roller being arranged for squeezing engagement with the pastry bag;

a drive mechanism located within the drive compartment, the drive mechanism being connected to the roller; and an operating lever pivotally mounted on the housing and connected to the drive mechanism, wherein the drive mechanism is responsive to actuation of the operating lever in a first pivot direction to displace the roller in a downward direction to discharge contents from the pastry bag through the dispensing tip, and the operating lever pivoting in a second pivot direction opposite the first pivot direction without causing the drive mechanism to displace the roller;

wherein the drive mechanism displaces the roller in the downward direction by a distance proportional to an angular displacement of the operating lever in the first pivot direction;

wherein the drive mechanism includes:

a push bar mounted on the operating lever at a location spaced from a pivot axis of the operating lever;

a vertically extending drive rod constrained for vertically directed displacement;

a linkage pivotally coupled to the push bar and to the drive rod, the drive rod being displaced in a downward direction as the operating lever is pivoted in the first pivot direction and in an upward direction as the operating lever is pivoted in the second pivot direction, wherein the drive rod is displaced by a distance proportional to the angular displacement of the operating lever in the first or second pivot direction; and a pawl assembly associated with the drive rod for displacement with the drive rod in the downward direction in response to pivoting of the operating lever in the first pivot direction, wherein the pawl assembly is released relative to the drive rod when the drive rod is displaced in the upward direction in response to pivoting of the operating lever in the second pivot direction;

wherein the operating lever is pivotally mounted on the housing at a vertical location above the base but below the bottom wall of the product compartment, and the linkage is a two-member linkage having a generally vertical first member extending upward from the push bar and a generally horizontal second member pivotally coupled to an upper end of the first member, the drive rod being pivotally coupled to the second member and the drive rod depending downwardly from the second member.

2. The topping dispenser according to claim 1, wherein the operating lever is spring-biased in the second pivot direction.

3. The topping dispenser according to claim 1, wherein the pawl assembly includes a pawl release member operable to release the pawl assembly from the drive rod so that the roller can be moved manually in the upward direction relative to the drive rod.

4. The topping dispenser according to claim 3, wherein the pawl release member extends from the drive compartment into the product compartment.

5. A topping dispenser comprising:

a base:

a housing supported by the base, the housing including a product compartment for receiving a pastry bag and drive compartment adjacent the product compartment, wherein the product compartment includes a bottom wall spaced from the base, the bottom wall having an opening therethrough;

a clamping member operable to clamp an upper portion of the pastry bag to suspend the pastry bag within the product compartment such that a lower dispensing tip of the pastry bag is insertable through the opening in the bottom wall of the product compartment;

a roller disposed within the product compartment for rotation about an axis, the roller being arranged for squeezing engagement with the pastry bag;

a drive mechanism located within the drive compartment, the drive mechanism being connected to the roller; and an operating lever pivotally mounted on the housing and connected to the drive mechanism, wherein the drive mechanism is responsive to actuation of the operating lever in a first pivot direction to displace the roller in a downward direction to discharge contents from the pastry bag through the dispensing tip, and the operating lever pivoting in a second pivot direction opposite the first pivot direction without causing the drive mechanism to displace the roller;

wherein the drive mechanism displaces the roller in the downward direction by a distance proportional to an angular displacement of the operating lever in the first pivot direction;

wherein the roller is connected to the drive mechanism by a U-shaped mounting bracket having a pair of legs extending from the drive compartment into the product compartment;

wherein the housing includes a partition between the product compartment and the drive compartment, and the pair of legs of the U-shaped mounting bracket extend through respective travel slots through the partition;

wherein the partition includes a vertically extending channel portion at a rear of the product compartment, wherein the channel portion has a horizontal bag slot for receiving the upper portion of the pastry bag, and the clamping member is a clamping plate slidable along the channel portion to releasably clamp the upper portion of the pastry bag against the channel portion.

6. The topping dispenser according to claim 5, further comprising a bail for holding the roller in an upward location above the bag slot.

7. A topping dispenser comprising:

a base;

a housing supported by the base, the housing including a product compartment for receiving a pastry bag and drive compartment adjacent the product compartment, wherein the product compartment includes a bottom wall spaced from the base, the bottom wall having an opening therethrough;

a clamping member operable to clamp an upper portion of the pastry bag to suspend the pastry bag within the product compartment such that a lower dispensing tip of the pastry bag is insertable through the opening in the bottom wall of the product compartment;

a roller disposed within the product compartment for rotation about an axis, the roller being arranged for squeezing engagement with the pastry bag;

a drive mechanism located within the drive compartment, the drive mechanism being connected to the roller; and an operating lever pivotally mounted on the housing and connected to the drive mechanism, wherein the drive mechanism is responsive to actuation of the operating lever in a first pivot direction to displace the roller in a downward direction to discharge contents from the pastry bag through the dispensing tip, and the operating lever pivoting in a second pivot direction opposite the first pivot direction without causing the drive mechanism to displace the roller;

wherein the drive mechanism displaces the roller in the downward direction by a distance proportional to an angular displacement of the operating lever in the first pivot direction;

wherein the operating lever is spring-biased in the second pivot direction;

wherein the push bar extends through an arcuate slot through a sidewall of the housing, and angular displacement of the operating lever in the second pivot direction is limited by engagement of the push bar with an end of the arcuate slot.

8. The topping dispenser according to claim 7, wherein angular displacement of the operating lever in the first pivot direction is limited by engagement of the push bar with an opposite end of the arcuate slot.

9. A topping dispenser comprising:

a base:

a housing supported by the base, the housing including a product compartment for receiving a pastry bag and drive compartment adjacent the product compartment, wherein the product compartment includes a bottom wall spaced from the base, the bottom wall having an opening therethrough;

a clamping member operable to clamp an upper portion of the pastry bag to suspend the pastry bag within the product compartment such that a lower dispensing tip of the pastry bag is insertable through the opening in the bottom wall of the product compartment;

a roller disposed within the product compartment for rotation about an axis, the roller being arranged for squeezing engagement with the pastry bag;

a drive mechanism located within the drive compartment, the drive mechanism being connected to the roller;

an operating lever pivotally mounted on the housing and connected to the drive mechanism, wherein the drive mechanism is responsive to actuation of the operating lever in a first pivot direction to displace the roller in a downward direction to discharge contents from the pastry bag through the dispensing tip, and the operating lever pivoting in a second pivot direction opposite the first pivot direction without causing the drive mechanism to displace the roller; and a first pair of guide wheels coaxially mounted with the roller for rotation about the horizontal axis of rotation of the roller, and wherein the housing has a first pair of vertically extending guide tracks at opposite sides of the product compartment, the first pair of guide tracks respectively receiving the first pair of guide wheels.

10. The topping dispenser according to claim 9, further comprising a second pair of guide wheels connected to the roller, and wherein the housing has a second pair of vertically extending guide tracks at opposite sides of the drive compartment, the second pair of guide tracks respectively receiving the second pair of guide wheels.

11. The topping dispenser according to claim 9, wherein the drive mechanism includes:

a push bar mounted on the operating lever at a location spaced from a pivot axis of the operating lever;

a coupler block having an elongated slot receiving the push bar, the coupler block being displaced in a downward direction as the operating lever is pivoted in the first pivot direction and in an upward direction as the operating lever is pivoted in the second pivot direction, wherein the coupler block is displaced by a distance proportional to the angular displacement of the operating lever in the first or second pivot direction;

a drive rod fixed to the coupler block and depending downwardly from the coupler block for displacement with the coupler block; and a pawl assembly associated with the drive rod for displacement with the drive rod in the downward direction in response to pivoting of the operating lever in the first pivot direction, wherein the pawl assembly is released relative to the drive rod when the drive rod is displaced in the upward direction in response to pivoting of the operating lever in the second pivot direction.

12. The topping dispenser according to claim 11, wherein the pawl assembly includes a pawl release member operable to release the pawl assembly from the drive rod so that the roller can be moved manually in the upward direction relative to the drive rod.

13. The topping dispenser according to claim 12, wherein the pawl release member extends from the drive compartment into the product compartment.

* * * * *